United States Patent [19]

Baker et al.

[11] Patent Number: 4,867,255

[45] Date of Patent: Sep. 19, 1989

[54] TECHNIQUE FOR STEERING A DOWNHOLE HAMMER

[75] Inventors: Glen O. Baker, Kent; Dmitry Feldman; Shiu S. Ng, both of Seattle; Albert W. Chau, Redmond; John E. Mercer, Kent, all of Wash.

[73] Assignee: FlowMole Corporation, Kent, Wash.

[21] Appl. No.: 196,945

[22] Filed: May 20, 1988

[51] Int. Cl.[4] ..... E21B 4/14; E21B 4/20; E21B 7/08; E21B 10/36

[52] U.S. Cl. ..... 175/61; 175/62; 175/122; 175/203; 175/296; 175/398; 175/415

[58] Field of Search ..... 175/61, 62, 19, 45, 175/73, 122, 296, 203, 398, 399, 415; 299/1

[56] References Cited

U.S. PATENT DOCUMENTS

| | | | |
|---|---|---|---|
| 94,854 | 9/1869 | Whartnaby . | |
| 172,529 | 1/1876 | Waring . | |
| 700,430 | 5/1902 | Lane . | |
| 1,894,289 | 1/1933 | Wood . | |
| 1,894,446 | 1/1933 | McKenny . | |
| 2,181,284 | 11/1939 | Potts . | |
| 2,196,940 | 4/1940 | Potts . | |
| 2,324,102 | 7/1943 | Miller et al. . | |
| 2,342,498 | 2/1944 | Spang . | |
| 2,350,986 | 6/1944 | Collins . | |
| 2,517,494 | 8/1950 | Kiss . | |
| 2,678,203 | 5/1954 | Huff . | |
| 2,903,239 | 9/1959 | Standridge . | |
| 3,163,243 | 12/1964 | Cleary | 175/399 X |
| 3,465,834 | 9/1969 | Southworth | 173/2 |
| 3,525,405 | 8/1970 | Coyne et al. | 175/61 X |
| 3,712,391 | 1/1973 | Coyne | 175/26 |
| 3,853,185 | 12/1974 | Dahl | 175/45 |
| 3,870,111 | 3/1975 | Tuomela | 175/11 |
| 3,891,038 | 6/1975 | Delestrade et al. | 175/7 |
| 3,905,431 | 9/1975 | Hasewend | 175/53 |
| 4,117,895 | 10/1978 | Ward | 175/53 |
| 4,135,588 | 1/1979 | Wagner | 175/19 |
| 4,144,941 | 3/1979 | Ritter | 175/61 X |
| 4,183,415 | 1/1980 | Stenuick | 175/92 |
| 4,299,298 | 11/1989 | McEnery et al. | 175/418 |
| 4,461,359 | 7/1984 | Jones, Jr. et al. | 175/61 |
| 4,465,147 | 8/1984 | Feenstra et al. | 175/61 X |
| 4,621,698 | 11/1986 | Pittard et al. | 175/305 |
| 4,625,815 | 12/1986 | Spies | 175/73 |
| 4,632,191 | 12/1986 | McDonald et al. | 175/19 |
| 4,637,479 | 1/1987 | Leising | 175/26 |
| 4,640,353 | 2/1987 | Schuh | 166/248 |
| 4,674,579 | 6/1987 | Geller et al. | 175/61 X |
| 4,694,913 | 9/1987 | McDonald et al. | 175/19 X |
| 4,714,118 | 12/1987 | Baker et al. | 175/61 X |

FOREIGN PATENT DOCUMENTS

| | | |
|---|---|---|
| 1169872 | 11/1962 | Fed. Rep. of Germany . |
| 2843055 | 4/1979 | Fed. Rep. of Germany . |
| 3012482 | 3/1980 | Fed. Rep. of Germany . |
| 3003686 | 8/1981 | Fed. Rep. of Germany . |
| 156784 | 5/1978 | Netherlands . |
| 2126267 | 3/1984 | United Kingdom . |

*Primary Examiner*—Stephen J. Novosad
*Attorney, Agent, or Firm*—Flehr, Hohbach, Test, Albritton & Herbert

[57] ABSTRACT

There is disclosed herein an apparatus for providing an underground tunnel utilizing a steerable pneumatically powered, elongated percussive downhole hammer having a forwardmost cutting bit which is asymmetrically configured with respect to the elongation axis of the hammer. This hammer is steered through the ground, that is, made to move along a straight path or a particular curved path, by controlling the way in which it is pneumatically powered and/or the way in which it is urged forward and/or the way in which its cutting bit is rotated.

27 Claims, 2 Drawing Sheets

TECHNIQUE FOR STEERING A DOWNHOLE HAMMER

The present invention relates generally to a technique for providing an underground tunnel by means of a pneumatically powered, elongated percussive downhole hammer which is caused to move through the soil, and more particularly with uncomplicated and reliable ways to steer the hammer as it moves through the soil.

Pneumatically powered, percussive downhole hammers utilizing forward-most, symmetrical cutting bits are well known in the art. One such hammer and bit is manufactured by HALCO and is used primarily for vertical, deep holes, 80–1000 feet or even deeper. The bit is designed to turn with the hammer by means of a drill string. During operation (when the hammer is pneumatically "energized"), the hammer's piston impacts the bit creating a series of indentations and cuttings (spoils) while rotating. Impacting at 1600 blows per minute while rotating at, for example 20 RPM, causes the tool to advance as it is urged forward by means of a drill string. Two sets of channels on the side of the bit are often used to remove the cuttings or spoils. One set directs air to the cutting face, the other set allows the cuttings to be exhausted back out of the hole.

The typical prior art downhole hammer utilizing a symmetrical cutting bit is not easily steerable along both straight and curved paths. However, more recently, a steerable, pneumatically powered percussive type of boring device was described in Gas Research Institute U.S. Pat. No. 4,694,913. This particular device utilizes an asymmetrically configured head so that it can be steered along a curved path. More specifically, as described in the GRI patent, the boring device can be moved along a straight line path by rotating its asymmetrical head as the device is urged forward. On the other hand, to move the boring device along a curved path, it is urged forward while the asymmetrical head does not rotate.

The percussive type of boring device disclosed in GRI patent No. 4,694,913 is not designed to produce spoils nor is it intended to do so, as pointed out in the patent itself. Rather, that device is intended for use in relatively soft soil that can be pierced through without the formation of cutting or spoils. This is to be contrasted with the present invention which contemplates utilizing a downhole hammer that is specifically designed to produce cuttings and spoils as it travels through relatively hard soil and even rock formations. The applicants believe that the spoils produced by the downhole hammer form a cushion between the cutting bit and the earth to be cut through, hindering or preventing cutting action of the hammer. These spoils must be removed from the face of the hammer for effective cutting.

Applicants have found it to be difficult, if not impossible, to steer a downhole hammer having an asymmetric cutting bit in the manner described in the '913 GRI patent. More specifically, applicants found that when they attempt to turn their device by stopping rotation of its asymmetrical cutting bit, the hammer tends to wedge itself into the soil and not move at all.

In view of the foregoing, it is an object of the present invention to provide a number of uncomplicated and yet reliable techniques for steering a pneumatically powered, percussive downhole hammer through the ground even in the presence of spoils, whereby ultimately to provide an underground tunnel.

As will be described in more detail hereinafter, the pneumatically powered, percussive downhole hammer disclosed herein has a forward most cutting bit which is asymmetrically configured with respect to the elongation axis of the hammer. The cutting bit is rotated about the elongation axis of the hammer while the latter is pneumatically powered (energized) and while it is urged forward in the ground, whereby to cause the hammer to move forward. In accordance with all of the embodiments of the present invention, in order to cause the hammer to move along a straight path, the asymmetrical cutting bit is rotated continuously either clockwise or counter-clockwise, at a constant speed. In accordance with one embodiment, to cause the hammer to turn, rotation of the cutting bit is modulated in a particular way depending upon how the hammer is to turn. In accordance with a second embodiment of the present invention, the hammer is urged forward in different ways in synchronism with rotation of the cutting bit to cause the hammer to either move straight or turn, e.g., its thrust force is modulated. In accordance with a third embodiment, the hammer is pneumatically powered in synchronism with rotation of the cutting bit in different ways to cause the hammer to either go straight or turn, e.g., its power is modulated. In accordance with a fourth embodiment the thrust force on the hammer is modulated without the cutting bit rotating at all in order to cause the hammer to turn.

The overall steerable downhole hammer disclosed herein and the ways in which it is operated to provide an underground tunnel will be described in more detail hereinafter in conjunction with the drawings wherein:

FIG. 1 diagrammatically illustrates an overall apparatus for providing an underground tunnel in accordance with the present invention;

Figure 1:
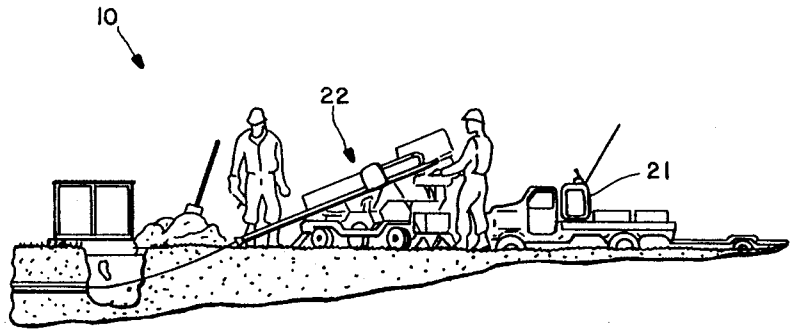
Figure 2:
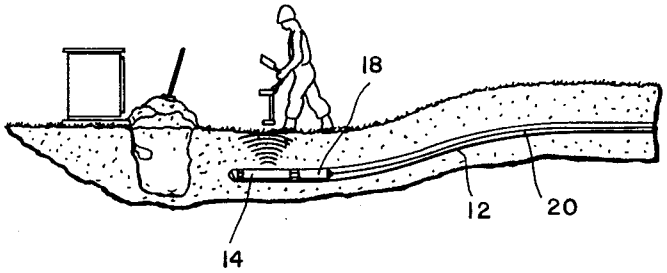
FIG. 2 is an enlarged diagrammatic illustration of a pneumatically powered, percussive downhole hammer and steerable cutting bit forming part of the overall apparatus of FIG. 1 and designed in accordance with the present invention.
Figure 7:
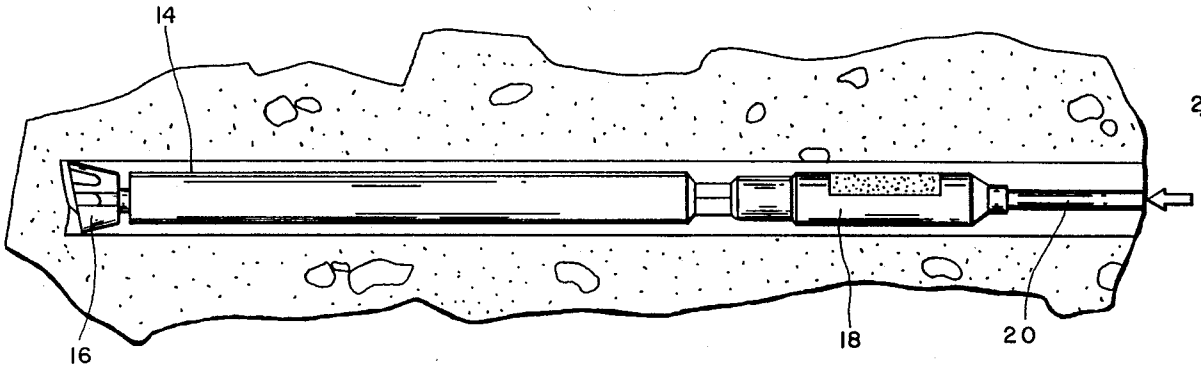
Figure 7:
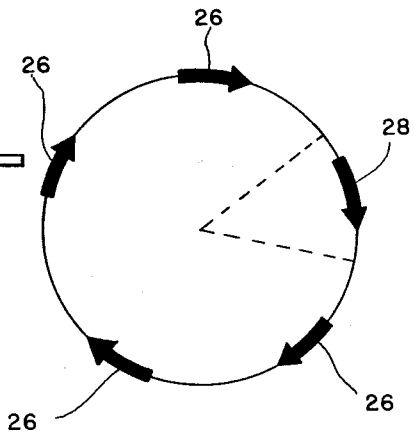
Figure 3:
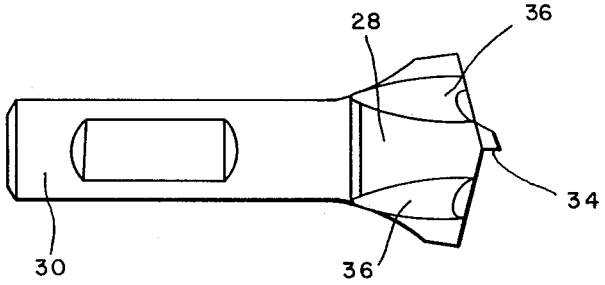
FIG. 3 is the top plan view of the steerable bit forming part of the downhole hammer illustrated in FIGS. 1 and 2.
Figure 4:
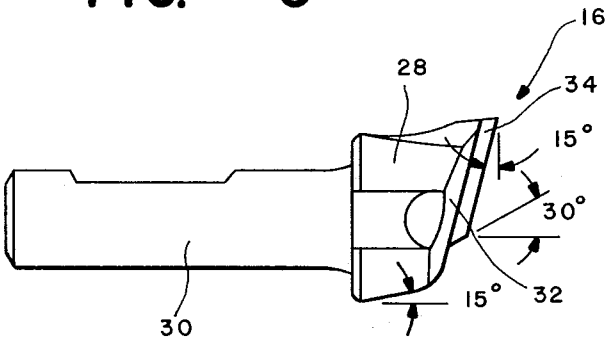
FIG. 4 is a side elevational view of the cutting bit of FIG. 3.
Figure 5:
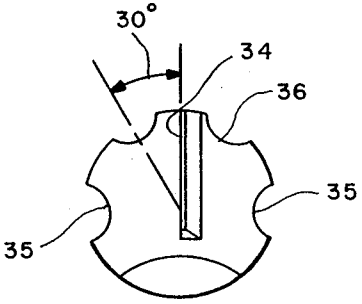
FIG. 5 is a front elevational view of the cutting bit of FIG., 4.
Figure 6:
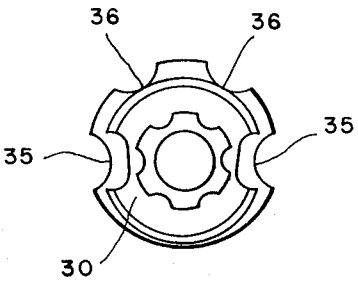
FIG. 6 is a back elevational view of the cutting bit of FIG. 4.

FIG. 7 diagrammatically illustrates an operating feature of the hammer of FIGS. 1 and 2.

Turning now to the drawings, wherein like components are designated by like reference numerals throughout the various figures, attention is first directed to FIG. 1. As indicated above, this figure diagrammatically illustrates an overall apparatus designed in accordance with the present invention for providing an underground tunnel. The apparatus is generally indicated by the reference numeral 10 and the tunnel which is being formed by the apparatus is shown at 12. Apparatus 10 includes a pneumatically powered, elongated percussive downhole hammer 14 having a forward-most cutting bit 16 (FIG. 2). The downhole hammer, apart from its cutting bit, is conventional and readily providable. One such hammer is manufactured by HALCO. In an actual working embodiment of the present invention, a HALCO downhole hammer model DA265 is used. The cutting bit 16 is not conventional but rather designed in accordance with the present invention to provide an asymmetrical cutting surface in order to make tee cutting bit and hammer steerable in the manner to be described hereinafter.

Still referring to FIG. 1 in conjunction with FIG. 2, the back end of downhole hammer 14 is connected to a housing 18 containing certain electronic components for reasons to be discussed below. The back end of housing 18 is connected to a keyed drill pipe or drill string 20 of the type described in U.S. Pat. No. 4,674,579 (Geller) which is incorporated herein by reference. Like the drill string in Geller U.S. Pat. No. 4,674,579, drill string 20 is comprised of a plurality of keyed or interlocking or interlocked longitudinal sections to allow the entire drill string to rotate as a single, integral unit. At the same time, the rearward end of the drill string, above ground, can be provided with additional drill string sections.

Overall apparatus 10 includes suitable means for including a source of pressurized air, for example compressor 21 for pneumatically powering (energizing) downhole hammer 14 and cooperating conduit for carrying the air to the hammer. The apparatus also includes an arrangement 22 for thrusting drill string 20 and therefore downhole hammer 14 and its associated cutting bit 16 forward through the ground, while at the same time rotating the drill string about its own axis and therefore rotating cutting bit 16 and downhole hammer 14 about the axis of the latter.

With certain exceptions to be noted, arrangement 22 may be identical to or readily providable in view of corresponding arrangement described in the Geller patent and illustrated in, for example, FIG. 1 of that patent. In the Geller patent, the arrangement disclosed there urges its drill string and cooperating boring tool forward in the ground while it either rotates or does not rotate the drill string and boring tool. In accordance with the Geller patent, the boring tool moves along a straight path if it is urged forward while rotating, either clockwise or counterclockwise, at a constant speed in the same manner as described in GRI Patent No. 4,694,913 and it is caused to turn in a particular direction by stopping its rotation altogether while being urged forward. As will be described hereinafter, arrangement 22 forming part of overall apparatus 10 differs from this Geller arrangement by the way in which it steers downhole hammer 14.

As indicated above, cutting bit 16 is asymmetrically configured in order to make it steerable. More specifically, as will be described hereinafter in conjunction with FIGS. 3–6, the cutting face is angled with respect to the axis of the bit so that, like in the Geller and GRI patent, it will move along a straight line path if rotated at a constant speed about its axis, assuming of course, that the downhole hammer itself is energized while at the same time being urged forward by means of arrangement 22. However, unlike the boring tools in the GRI and Geller patents, downhole hammer 14 is not made to turn merely by ceasing rotation of its cutting bit 16. As stated previously, applicants have found that this approach is not reliable for use by a downhole hammer because of the presence of spoils. Rather, as will be seen below, apparatus 10 (1) modulates rotation of cutting bit 16 in different ways to be described, or (2) it modulates the way in which the downhole hammer is urged forward in synchronism with rotation of the cutting bit, (3) it modulates the way in which the downhole hammer is energized in synchronism with rotation of the cutting bit, (4) a combination of all of these.

As indicated immediately above, one way to cause the downhole hammer 14 and its associated cutting bit 16 to turn is to modulate rotation of cutting bit. More specifically, rather than stopping rotation of the drill string and therefore the downhole hammer and cutting bit as in the GRI and Geller patents, the cutting bit is rotated slower through a particular segment of its path of rotation than the rest of its rotational path or is caused to move back and forth through that segment a greater number of times during each complete revolution of the bit, thereby causing the cutting bit and downhole hammer to turn in the direction of that segment. This technique assumes that the hammer is continuously being urged forward with constant thrust force of, for example 1000 lbs. of force and that it is continuously energized resulting in, for example, 1600 blows (percussions) per minute. A similar approach is described in U.S. Pat. No. 4,714,118 (Baker) which is also incorporated herein by reference. In order to modulate cutting bit 16 in this way, arrangement 22 must include a drive motor which is variable in speed and/or reversible. To this extent, arrangement 22 may, indeed, differ from the corresponding arrangement in Geller Patent No. 4,674,679. The present invention also contemplates stopping bit 16 to cause the hammer to turn, as in the GRI and Geller patents. However, during the time that the hammer turns, the bit is periodically rotated, either 360° (making one or more revolutions) or back and forth through a lesser segment of its rotational path, in order to allow spoils to pass rearwardly beyond the bit.

In accordance with a second steering technique in accordance with the present invention, the cutting bit 16 is continuously rotated at, for example, 20 RPM. But rather than continuously urging the downhole hammer forward, with, for example, 1000 pounds of thrust force, which would cause the hammer to go straight, the thrust force is modulated in synchronism with rotational movement of cutting bit 16. This is best explained in connection with FIG. 7 which diagrammatically depicts the rotational path of cutting bit 16 by means of arrows 26 and 28. Arrows 26 correspond to the position of a specific point on the cutting bit as it moves through most of its rotational path while arrow 28 corresponds to a small segment of the path depending upon the particular direction in which the downhole hammer is to turn. For purposes of this discussion, the segment corresponding to arrow 28 will be referred to as the turning segment, and corresponds to the turning segment described above in conjunction with Baker U.S. Pat. No. 4,714,118. See specifically FIGS. 5A, 5B and 5C in the Baker patent.

Assuming that cutting bit 16 rotates at a constant speed and further assuming that it is urged forward with constant thrust force, the downhole hammer will move along a straight line path. However, in accordance with the present invention, in order to turn the downhole hammer in accordance with this technique, the forward thrust force applied to the downhole hammer is intermittently increased as the cutting bit moves through steering segment 28. For example, the thrust force applied to the downhole hammer as it moves through path segment 26 may be 200 lbs. or zero (no thrust) and as it moves through segment 28 it is increased to 1000 lbs. As a result, the downhole hammer will turn in the direction dictated by segment 28.

A third steering approach in accordance with the present invention is similar to the one described above, but rather than modulating the thrust force applied to downhole hammer 14, energization of the hammer is modulated in synchronism with rotation of cutting bit 16. More specifically it will again be assumed that the cutting bit is rotating at a constant speed, in one direction, as diagrammatically depicted in FIG. 7. Thus, in order to cause the hammer to turn in the direction dictated by segment 28, it is deenergized entirely (its pneumatic power is cut off) or its pneumatic power is lessened during the period that the cutting bit moves through section 26 of its rotational path. As the cutting bit moves through section 28, it is again energized or its pneumatic power is increased. This will cause the hammer to turn in the direction dictated by segment 28.

It should be apparent that all three of the approaches just described could be combined That is, rotation of the cutting bit 16 could be modulated so that a particular point spends more time along segment 28 of its rotational path while, at the same time, the downhole hammer could be urged forward with greater thrust force while the cutting bit moves through section 8 and, at the same time, the downhole hammer could be energized with a greater amount of pneumatic power during that period. In all of these cases, it should be noted that the cutting bit does not remain stationary during the turning procedure, as is the case in both the GRI and Geller patents. Because the cutting bit does move during the turning procedure, the spoils are allowed to more readily pass behind the cutting bit and not act as a cushion to prevent it from other cutting action and thereby stalling.

The steering procedures just described presuppose that the overall apparatus is capable of monitoring the position of cutting bit 16, actually a particular point on the bit, along its rotational path 26, 28. This can be readily accomplished in accordance with the teachings in Geller U.S. Pat. No. 4,674,579 since the downhole hammer 14 and the cutting bit 16 rotate with the drill string in the same manner as described in the Geller patent. The particular point on the cutting bit being monitored could be any point, for example, a cutting tooth to be described below. On the other hand, the present invention could be modified such that the drill string is replaced with a nonrotating conduit such as the one disclosed in Baker U.S. Pat. No. 4,714,118. In that case, a downhole motor for rotating the cutting bit 16 relative to the downhole hammer, or rotating both relative to the conduit, could be provided. At the same time, the overall system would be provided with suitable means corresponding to those in the Baker patent to monitor the rotational position of cutting bit 16 at any point in time along its path 26,28. In either case, it is necessary to monitor the overall inground position of the downhole hammer at any given point as it moves through the ground. Both the Geller and Baker patents describe suitable techniques.

In accordance with a specific technique for monitoring the inground position of the downhole hammer, an overall guidance system for apparatus 10 is used and consists of a transmitter at the hammer and an above ground locator similar to one described in co-pending Ser. No. 866,242 filed on May 22, 1987 and entitled ARRANGEMENT FOR AND METHOD OF LOCATING A DISCRETE INGROUND BORING DEVICE, now U.S. Pat. No. 4,806,869. An arrangement of suitable electronic components are provided within housing 18 which consists of a nonmetallic window on a steel housing. A transmitter using a crystal controlled oscillator can be provide for driving a Class D amplifier. The output of the amplifier could be connected to a series tuned LC tank network with the inductor being a ferrite rod which is the antenna. The entire transmitter could be shock mounted to withstand the vibration caused by the percussive hammer. For better control, a pitch sensing device can be added as described in the Geller patent and a roll sensor for head orientation could also be added such as the one described in the Baker patent. In any event, the present invention does not reside in the ability to monitor the position of the downhole hammer per se or the position of its cutting bit. Rather, the present invention resides in the different ways in which the downhole hammer and its cutting bit are operated to cause it to turn, as described above.

Of the three embodiments described above, each of the latter two requires modulation of its thrust force and/or modulation of its pneumatic power. Both arrangement 22 and the pneumatic power supply means can be readily operated in accordance with the teachings herein to provide the desired modulation. A forth steering approach, different than the three described above, does not rely on rotation of the cutting bit during the turning procedure. To that extent, this forth approach is similar to the steering techniques described in the GRI and Geller patents. However, in both of these latter patents, the boring tools are continuously urged forward at a constant thrust force. In accordance with this forth approach, in order to turn the downhole hammer, rotation of its cutting bit is stopped. However, at the same time, the thrust force on the hammer is modulated in a particular way. Specifically, the hammer is first urged forward so as to move a certain distance, for example, one foot. It is then pulled back a shorter distance, for example, six inches and then thrust forward again a greater distance, for example, one foot, and so on. This allows the spoils to move rearwardly and not create a cushion preventing further cutting action of bit 16. In active tests it was found that rotation during pullback aides spoils removal. Either of the thrust mechanisms described in the Geller and Baker patents could be readily modified to provide this modulated thrust.

All four of the steering techniques described above rely on the fact that cutting bit 16 itself is specifically designed in an asymmetrical fashion to turn when acted upon in the manner described. FIGS. 3–6 illustrate cutting bit 16 designed in accordance with an actual working embodiment. The bit has a cutting head 29 on the front end of a shank 30 and defining a cutting face 32, which carries a cutting tooth 34. The normal 40 to the bits cutting face is typically angled 10° to 30° with respect to the axis of shank 30 which is coextensive with the axis of downhole hammer 14. This angle provides a side force for steering. A second surface whose normal 41 is in the plane of the normal to first surface is cut into the bit's face. This second surface's normal forms an acute angle of about 15° with the normal 42 to the hammer's axis to assist steering and to provide chip (spoils) clearance. On the face of the bit is cutting tooth 34 or buttons, (not shown). The cutting edge is in the plane of the steering direction. During continuous rotation of the bit at constant speed, in one direction or the other, the tooth or buttons cut a cone shaped microtunnel face. Air is channeled to the cutting face from the same supply 21 or from a different supply through channels 35 to flush the cuttings (spoils) rearward through channels 36. When the downhole hammer is steered in accordance with the modulating procedures described above, the bit "ramps" on the microtunnel face. This forces the downhole hammer into the desired steering direction. As a new microtunnel is formed, the second surface on the bit adds to the steering force.

While hammer 14 has been described as a pneumatically powered tool, it is to be understood that the present application would also be suitable with impact type boring tools that operate hydraulically or even electrically To that extent the three types of tools would be equivalent.

We claim:

1. An apparatus for providing an underground tunnel, comprising:

(a) a pneumatically powered, elongated percussive downhole hammer having a forward most cutting bit which is asymmetrically configured with respect to the elongation axis of the hammer;

(b) pneumatic means for powering said hammer while the latter is in the ground;

(c) means for urging said hammer forward as it is powered by said pneumatic means, whereby to cause the hammer to move forward in the ground; and (d) means for rotating said cutting bit about the elongation axis of said hammer in a first way for causing the hammer to move forward along a straight path and in a second way for causing the hammer to move forward along a particular curved path that depends upon the way in which the cutting bit is moved, said means for rotating said cutting bit including (i) means for rotating said bit in said one way at a constant speed about the elongation axis of said hammer so as to cause the hammer to move along a straight path, and (ii) means for rotating said bit in said second way about the elongation axis of said hammer such that a particular part of said bit spends more time along a specific segment of its rotation path about said axis than along the rest of the rotation path, whereby said specific segment of said rotating path determines the particular curved path of said hammer.

2. An apparatus according to claim 1 wherein said hammer, as it moves forward through the ground, produces spoils in front of said cutting bit and wherein said cutting bit includes at least one channel to accommodate the passage of said spoils rearwardly past the bit as the hammer moves forward.

3. An apparatus according to claim 2 wherein said bit includes at least one other channel and wherein the apparatus includes means for directing a stream of air forward through said other channel in order to force said spoils rearwardly through the first-mentioned channel.

4. An apparatus according to claim 1 wherein said means for moving said bit in said second way includes motor means and means for modulating the speed of said motor means and therefore the speed of said cutting bit depending upon the path to be taken by said hammer.

5. An apparatus according to claim 1 wherein said means for moving said bit in said second way includes reversible and motor means and bit means for modulating the direction of rotation of said motor means and therefore said cutting bit depending upon the path to be taken by the hammer.

6. An apparatus according to claim 1 wherein said cutting bit includes a cutting tooth which serves as a particular part of said bit.

7. An apparatus according to claim 1 wherein said cutting bit includes a cutting face having a normal which is angled approximately 20° with respect to the elongation axis of said hammer.

8. An apparatus according to claim 7 wherein said cutting bit includes a second surface whose normal is in the plane of the normal to said cutting face, said normal of said second surface forming an acute angle of approximately 15° with the normal to the hammer's axis.

9. An apparatus according to claim 8 wherein said cutting bit includes a cutting tooth on said cutting face, said cutting tooth being configured such that the cutting tooth cuts a cone shaped tunnel face in the ground if the cutting bit is rotated at a constant speed about the elongation axis of the hammer.

10. An apparatus according to claim 1 wherein said means for urging said hammer forward does so continuously when said cutting bit is moved about the elongation axis of said hammer in said first way for causing the hammer to move forward along a straight path, and wherein said urging means urges said hammer forward intermittently in synchronism with the time said specific part of said bit moves through said specific segment of its rotation path as said bit moves in said second way, whereby to cause said hammer to move forward along a particular curved path.

11. An apparatus according to claim 1 wherein said pneumatic means for powering said hammer does so continuously as said cutting bit is moved in said first way for causing the hammer to move forward along a straight path, and wherein said pneumatic means powers said hammer intermittently in synchronism with the time said cutting bit spends along said specific segment of its rotation path when the bit moves in said second way, whereby to cause the hammer to move along a curved path.

12. An apparatus for providing an underground tunnel, comprising:

(a) a pneumatically powered, elongated percussive downhole hammer having a forward most cutting edge which is asymmetrically configured with respect to the elongation axis of the hammer;

(b) pneumatic means for powering said hammer when the latter is in the ground;

(c) means for rotating said cutting bit about the elongation axis of said hammer; and (d) means for urging said hammer forward in a first way as said cutting bit rotates and said hammer is powered for causing the hammer to move forward along a straight path, and in a second way for causing the hammer to move forward along a particular curved path that depends upon the way in which the hammer is urged forward in a second way.

13. An apparatus according to claim 12 wherein said rotating means rotates said bit about the elongation axis of the hammer at constant speed and wherein said means for urging said hammer forward in said first way does so by urging it continuously with a substantially uniform thrust force and wherein said means for urging said hammer forward in said second way does so by urging said hammer forward with greater thrust force as said drill bit rotates through a particular segment of its rotational path about the elongation axis of the hammer than the thrust force applied to the hammer as the bit moves through the rest of its rotational path, whereby the particular segment of rotation of the bit determines the curved path that the hammer takes.

14. An apparatus for providing an underground tunnel, comprising:

(a) a pneumatically powered, elongated percussive downhole hammer having a forward most cutting bit which is asymmetrically configured with respect to the elongation axis of the hammer;

(b) means for urging said hammer forward;

(c) means for rotating said cutting bit about the elongation axis of said hammer; and (d) pneumatic means for powering said hammer in a first way while said hammer is urged forward and while said cutting bit is rotated about the elongation axis of the hammer whereby to cause the hammer to move forward along a straight path, and in a second way for causing the hammer to move forward along a particular curved path that depends upon the specific way in which the pneumatic means powers said hammer.

15. An apparatus according to claim 14 wherein said rotating means rotates said bit at a constant speed and wherein said pneumatic means powers said hammer in said first way by powering it continuously as said cutting bit is rotated about the elongation axis of said hammer, and wherein said pneumatic means powers said hammer in said second way by powering it intermittently only in synchronism with the time said cutting bit spends rotating through a particular segment of its rotational path about the elongation axis of said hammer, whereby said particular segment determines the curved path that the hammer takes.

16. A method of providing an underground tunnel comprising:

(a) providing a pneumatically powered, elongated percussive downhole hammer having a forwardmost cutting bit which is asymmetrically configured with respect to the elongation axis of the hammer;

(b) pneumatically powering said hammer while the latter is in the ground;

(c) urging said hammer forward as it is powered by said pneumatic means, whereby to cause to hammer to move forward in the ground; and (d) rotating said cutting bit about the elongation axis of said hammer in a first way for causing the hammer to move forward along a straight path and in a second way for causing the hammer to move forward along a particular curved path that depends upon the way in which the cutting bit is moved, said rotating step including (i) rotating said bit in said first way at a constant speed about the elongation axis of said hammer so as to cause the hammer to move along a straight path, and (ii) rotating said bit in said second way about the elongation axis of said hammer such that a particular part of said bit spends more time along a specific segment of its rotation path about said axis than along the rest of the rotation path, whereby said specific segment of said rotating path determines the particular curved path of said hammer.

17. A method according to claim 16 wherein said step of rotating said bit in said second way includes the step of modulating the speed of said cutting bit depending upon the path to be taken by said hammer.

18. A method according to claim 16 wherein s id step of rotating said bit in said second way includes the step of modulating the direction of rotation of said cutting bit depending upon the path to be taken by the hammer.

19. A method according to claim 16 wherein said step of urging said hammer forward does so continuously when said cutting bit is moved about the elongation axis of said hammer in said first way for causing the hammer to move forward along a straight path, and wherein said urging step urges said .hammer forward intermittently in synchronism with the time said specific part of said bit moves through said specific segment of its rotation path as said bit moves said second way, whereby to cause said hammer to move forward along a particular curved path.

20. A method according to claim 16 wherein said step of power in said hammer does so continuously as said cutting bit is moved in said first way for causing the hammer to move forward along a straight path, and wherein said step of powering said hammer powers said hammer intermittently in synchronism with the time said cutting bit spends along said specific segment of its rotation path when the bit moves in said second way, whereby to cause the hammer to move along a curved path.

21. A method of providing an underground tunnel, comprising:

(a) providing a pneumatically powered, elongated percussive downhole hammer having a forwardmost cutting edge which is asymmetrically configured with respect to the elongation axis of the hammer;

(b) pneumatically powering said hammer when the latter is in the ground;

(c) rotating said cutting bit about the elongation axis of said hammer; and (d) urging said hammer forward in a first way as said cutting bit rotates and said hammer is powered for causing the hammer to move forward along a straight path, and in a second way for causing the hammer to move forward along a particular curved path that depends upon the way in which the hammer is urged forward in said second way.

22. A method according to claim 21 wherein said rotating step rotates said bit about the elongation axis of the hammer at constant speed and wherein said urging of said hammer forward in said first way does so by urging it continuously with a substantially uniform thrust force and wherein said urging of said hammer forward in said second way does so by urging said hammer forward with greater thrust force as said drill bit rotates through a particular segment of its rotational path about the elongation axis of the hammer than the thrust force applied to the hammer as the bit moves through the rest of its rotational path, whereby the particular segment of rotation of the bit determines the curved path that the hammer takes.

23. A method of providing an underground tunnel, comprising:

(a) providing a pneumatically powered, elongated percussive downhole hammer having a forwardmost cutting bit which is asymmetrically configured with respect to the elongation axis of the hammer;

(b) urging said hammer forward;

(c) rotating said cutting bit about the elongation axis of said hammer; and (d) pneumatically powering said hammer in a first way while said hammer is urged forward and while said cutting bit is rotated about the elongation axis of the hammer whereby to cause the hammer to move forward along a straight path, and in a second way for causing the hammer to move forward along a particular curved path that depends upon the specific way in which the pneumatic means powers said hammer.

24. A method according to claim 23 wherein rotating step rotates said bit at a constant speed and wherein said hammer is powered in said first way by it being powered continuously as said cutting bit is rotated about the elongation axis of said hammer and wherein said hammer is powered in said second way by it being powered only in synchronism with the time said cutting bit spends rotating through a particular segment of its rotational path about the elongation axis of said hammer, whereby said particular segment determines the curved path that the hammer takes.

25. A method of providing an underground tunnel, comprising:

(a) providing a pneumatically powered, elongated percussive downhole hammer having a forwardmost cutting bit which is asymmetrically configured with respect to the elongation axis of the hammer;

(b) pneumatically powering said hammer while the latter is in the ground;

(c) intermittently rotating the cutting bit about the elongation axis of said hammer;

(d) continuously urging said hammer forward as said hammer is powered and said cutting bit is rotated in order to move said hammer forward along a straight path; and (e) intermittently urging said hammer forward specific distances and alternatively pulling it rearwardly lesser distances as the hammer is powered, in order to cause said hammer to move forward along a curved path.

26. A method according to claim 25 wherein said cutting bit is not rotated during said intermittent urging step.

27. A method according to claim 25 wherein said bit is rotated when said hammer is intermittently pulled rearwardly but not when it is intermittently urged forward.

* * * * *